US006012788A

United States Patent [19]

Marschand et al.

[11] Patent Number: 6,012,788

[45] Date of Patent: Jan. 11, 2000

[54] LAPTOP COMPUTER DESK

[75] Inventors: Bret Marschand, Grand Rapids; Tim Fookes, Grandville; Bryan Roels, Hamilton; Linda E. Chesser; William F. Schacht, both of East Grand Rapids, all of Mich.

[73] Assignee: Haworth, Inc., Holland, Mich.

[21] Appl. No.: 09/302,386

[22] Filed: Apr. 30, 1999

[51] Int. Cl.[7] ..... A47B 81/00

[52] U.S. Cl. ..... 312/223.3; 312/194; 312/290; 108/25

[58] Field of Search ..... 312/223.3, 223.6, 312/194, 195, 196, 208.1, 208.3, 208.5, 290, 215, 327; 108/25, 50.01, 50.02

[56] References Cited

U.S. PATENT DOCUMENTS

| | | | |
|---|---|---|---|
| 670,370 | 3/1901 | Dewhurst . | |
| 764,832 | 7/1904 | Valentine | 312/194 |
| 992,640 | 5/1911 | Byron . | |
| 993,588 | 5/1911 | Donning . | |
| 1,285,612 | 11/1918 | Byron . | |
| 1,293,952 | 2/1919 | Shirley . | |
| 1,543,980 | 6/1925 | Blood . | |
| 1,705,151 | 3/1929 | Card . | |
| 1,759,178 | 5/1930 | Weldon . | |
| 1,893,720 | 1/1933 | Vandervoort . | |
| 1,942,856 | 1/1934 | Davis . | |
| 2,230,444 | 2/1941 | Balster . | |
| 2,725,274 | 11/1955 | Stivale | 312/290 |
| 2,893,533 | 7/1959 | Childs . | |
| 3,298,325 | 1/1967 | Meath et al. | 108/25 |
| 4,312,507 | 1/1982 | Smith et al. . | |
| 4,345,803 | 8/1982 | Heck | 312/208.1 |
| 4,896,070 | 1/1990 | Reid et al. | 312/290 |
| 5,094,514 | 3/1992 | Grosch | 312/194 |
| 5,199,773 | 4/1993 | Price, Jr. et al. | 312/7.2 |
| 5,273,250 | 12/1993 | Pemberton et al. | 248/918 |
| 5,299,861 | 4/1994 | Foliot et al. | 312/194 |
| 5,329,865 | 7/1994 | McWard | 109/50 |
| 5,360,264 | 11/1994 | Crane | 312/293.1 |
| 5,437,235 | 8/1995 | Randolph | 108/25 |
| 5,568,773 | 10/1996 | Hung | 312/223.3 X |
| 5,596,482 | 1/1997 | Horikoshi | 361/683 |
| 5,611,608 | 3/1997 | Clausen | 312/223.3 |
| 5,697,686 | 12/1997 | Miller et al. | 312/194 |
| 5,769,514 | 6/1998 | Brown et al. | 312/195 |
| 5,859,762 | 1/1999 | Clark et al. | 361/686 |

FOREIGN PATENT DOCUMENTS

| | | | |
|---|---|---|---|
| 653871 | 3/1929 | France | 108/25 |

*Primary Examiner*—Peter M. Cuomo
*Assistant Examiner*—James O. Hansen
*Attorney, Agent, or Firm*—Flynn, Thiel, Boutell & Tanis, P.C.

[57] ABSTRACT

A laptop computer desk includes an interior storage compartment which is defined below worksurface level and has a triangular shape to accommodate a laptop computer therein. The storage compartment is enclosed by a front door and top doors wherein the front door folds down to define a wrist rest while the top doors fold over onto the work surface to define blotters or writing areas adjacent to the storage compartment. The interior of the storage compartment includes a receptacle unit for power and/or communication outlets, and flexible fabric divider walls which define interior compartments for storing cables.

18 Claims, 7 Drawing Sheets

LAPTOP COMPUTER DESK

FIELD OF THE INVENTION

The invention relates to a laptop computer desk having an interior compartment and more particularly, to an improved desk arrangement which is particularly suitable for use with a laptop computer.

BACKGROUND OF THE INVENTION

While desktop computers have been in use in offices for an extended period of time, laptop computers also are becoming prevalent in offices. Numerous desks, keyboard supports and the like have been designed to accommodate desktop computers and components therefore. However, since laptop computers are smaller than desktop units and are formed as a single unit with an integrated keyboard and monitor, laptop computers require significantly less space than desktop computers. As a result, furniture components designed to accommodate desktop computers often do not efficiently accommodate laptop computers thereon.

In order to better accommodate the unique characteristics of laptop computers, additional furniture components and accessories have been designed in an effort to efficiently integrate the use and storage of such computers in an office area. Examples of such furniture components include lockable trays or compartments which can be bolted or fastened to existing furniture units. These add-on components, however, may not blend well with existing furniture components, for example, due to differences in the aesthetic appearance of these components and the furniture to which they are attached. Further, such furniture components may not be designed to readily accommodate the power and/or communication cabling requirements of the laptop computer.

While older desk arrangements have been designed with interior compartments to store typewriters and the like therein, such designs also do not readily accommodate the unique requirements of laptop computers, for example, with respect to cabling, mousing and peripherals associated therewith.

It therefore is an object of the present invention to provide a laptop computer desk which is able to readily accommodate a laptop computer therein both during storage and use.

More particularly, the laptop computer desk of the invention includes an interior storage compartment defined beneath a worksurface which said worksurface is disposed at a conventional worksurface height. The storage compartment has a triangular shape when viewed from above to accommodate the laptop computer in a center area thereof while providing spaces sidewardly of the computer for storage, cabling, mousing or the like. Further, this triangular shape permits a pair of top doors which have a corresponding triangular shape to be opened onto the top of the worksurface wherein the triangular doors are disposed to the left and right sides of the storage compartment. These open doors thereby define side areas which can be used as writing areas.

The interior storage compartment also includes flexible divider walls which further define smaller cable compartments on the left and right sides of the interior storage compartment which said cable compartments provide for the storage of excess power and/or communication cabling. Further, a removable receptacle unit is provided at the back end of the interior storage compartment to provide continuous access to power and or communication outlets even when the storage compartment is closed.

Other objects and purposes of the invention, and variations thereof, will be apparent upon reading the following specification and inspecting the accompanying drawings.

Figure 1:
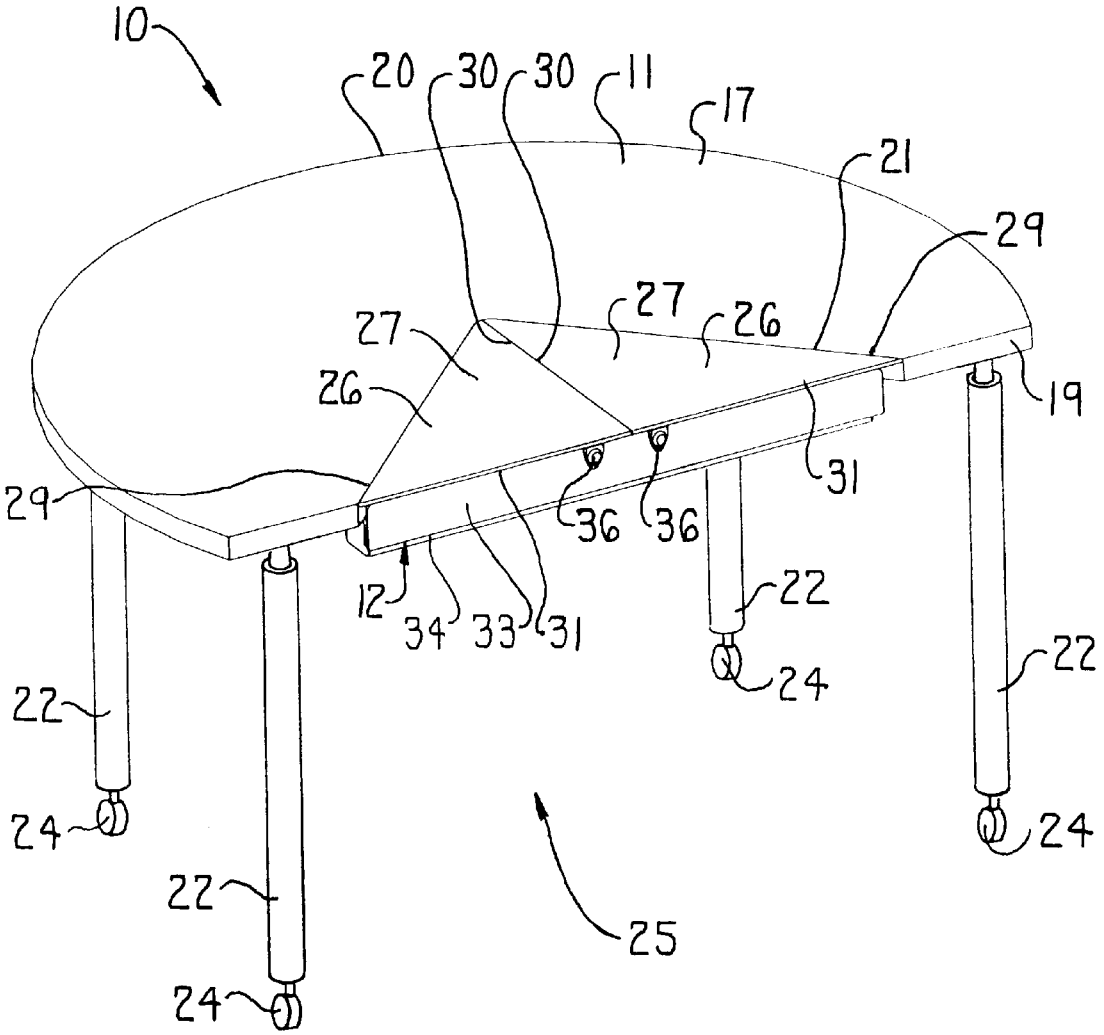
FIG. 1 is a perspective view of a laptop computer desk of the invention in a closed position.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to FIG. 1, a laptop computer desk 10 of the invention is illustrated. The computer desk 10 includes a planar desktop or worksurface 11 and a triangular-shaped compartment housing 12 which extends downwardly of the desktop 11 and defines a storage compartment 14 for a laptop computer as generally illustrated in FIG. 4.

Figure 4:
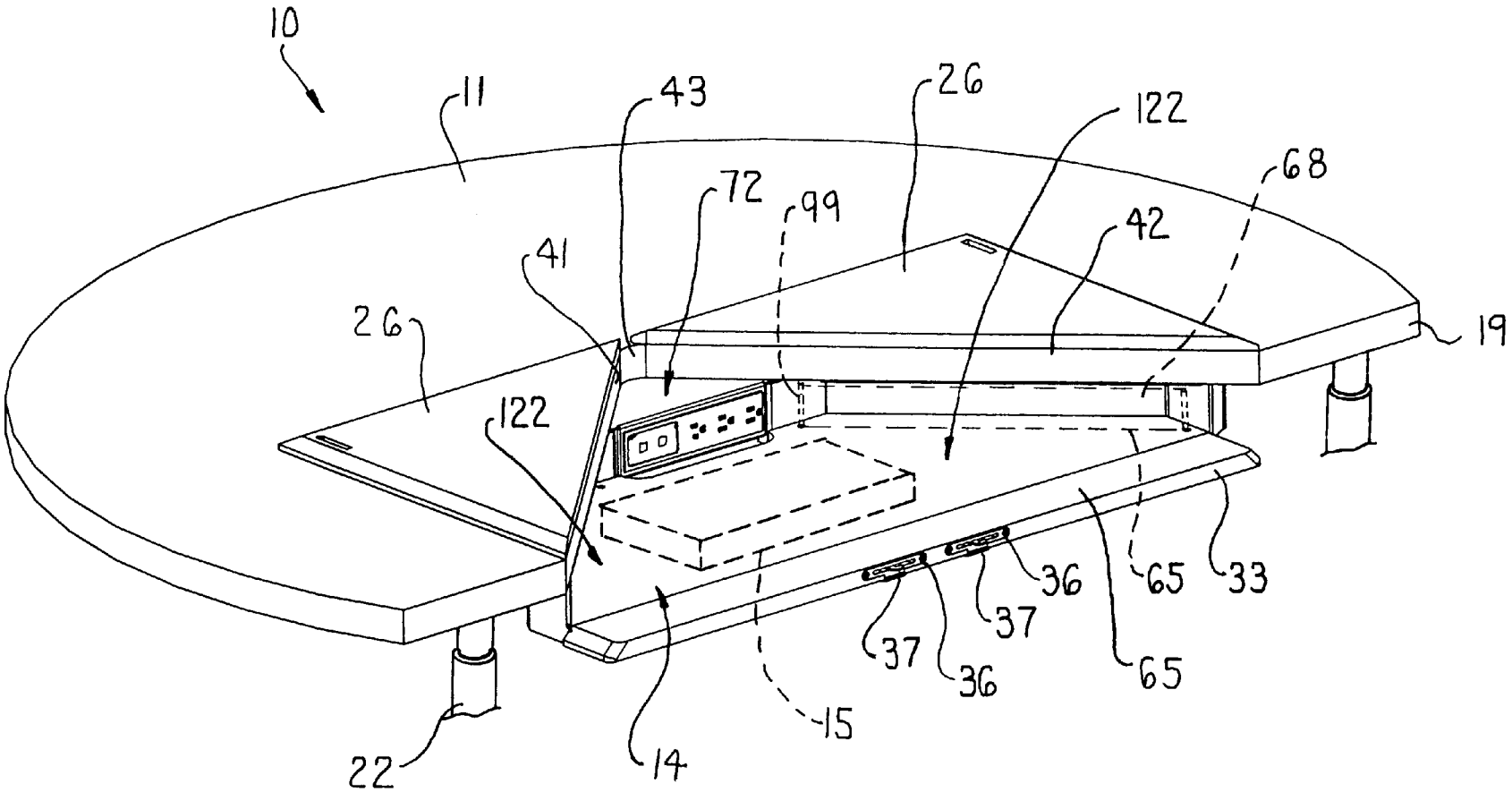
FIG. 4 is a partial perspective view of the laptop computer desk in an open position.

Generally in use, the computer desk 10 is closable to define a planar worksurface 17 extending across the entire desktop 11 when in the closed condition of FIG. 1, and openable to expose the interior storage compartment 14 when in the open condition of FIG. 4. The computer desk 10 thereby permits use and storage of a laptop computer 15 (FIG. 4) within the storage compartment 14, and is lockable to further provide security to the computer 15.

Figure 2:
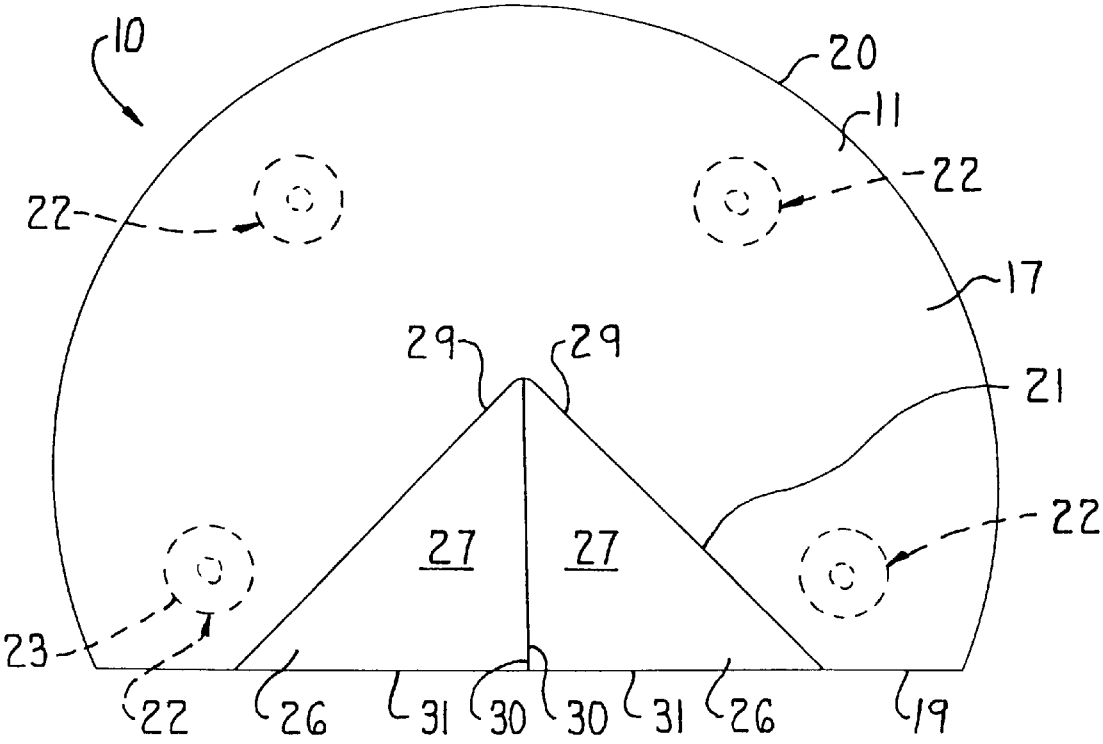
FIG. 2 is a plan view of the laptop computer desk of FIG. 1.
Figure 3:
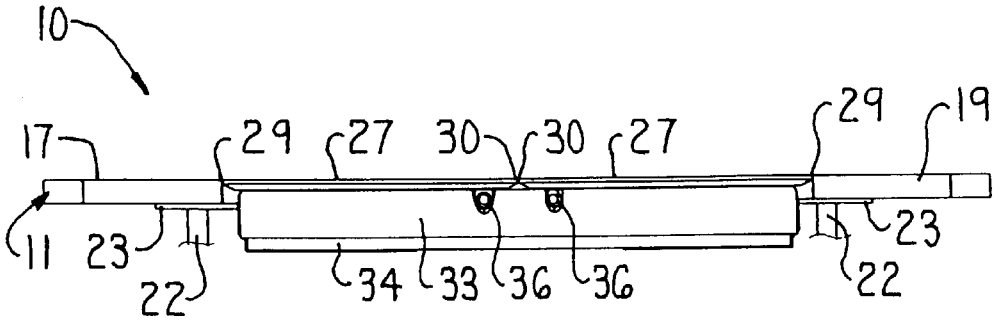
FIG. 3 is a front elevational view of the laptop computer desk.

More particularly, referring to FIGS. 1–3, the desktop 11 is a horizontally enlarged panel having a linear front edge 19 which extends laterally across the width of the computer desk 10. The back edge 20 has a partial circular shape although any desired shape may also be provided such as rectangular. A central portion of the front edge 19 is removed to define a generally triangular opening 21 in the worksurface 17.

The desktop 11 is supported by four support legs 22 which are disposed in load bearing relation with a floor. The legs 22 have a circular mounting plate 23 at the top end thereof (FIGS. 2 and 3) which is secured to the underside of the desktop 11 by fasteners. The lower end of each leg 22 also includes a caster 24, and the frontmost legs 22 are laterally spaced apart to define a knee space 25 therebetween for an occupant.

Generally, in the triangular opening 21 of the desktop 11, the storage compartment housing 12 is mounted in place. The compartment housing 12 includes a pair of triangular top doors 26 which overlie the storage compartment 14 when in the closed position of FIGS. 1–3. Each top door 26 is bounded by a hinged edge 29 which is hingedly connected to the desktop 11, an inner edge 30 and a front edge 31. Further, each top door 26 has a first surface 27 which faces upwardly when in the closed position and is disposed coplanar with the worksurface 17. Thus, an occupant can use the entire top surface of the computer desk 10 when the top doors 26 are closed.

The compartment housing 12 further includes a front door 33 which extends vertically upwardly from a bottom wall 34 to enclose the front side of the storage compartment 14. To lock the compartment housing 12, the front door 33 includes lock units 36 wherein the lock units 36 include latches 37 (FIG. 4) that engage a respective one of the top doors 26 proximate the front edge 31 thereof.

More particularly with respect to the components of the compartment housing 12 as seen in FIGS. 4–7, the triangular opening 21 of the desktop 11 is defined by left and right edges 41 and 42 which converge towards each other to an apex 43 which is disposed rearwardly away from the front worksurface edge 19. Adjacent to the left and right edges 41 and 42, the compartment housing 12 includes housing sides 45 which mount to the bottom of the desktop 11. Each housing side 45 includes a vertical side wall 46 which defines a side surface of the storage compartment 14, a top flange 47, a bottom flange 48, a front flange 49 and a rear flange 50.

Figure 9:
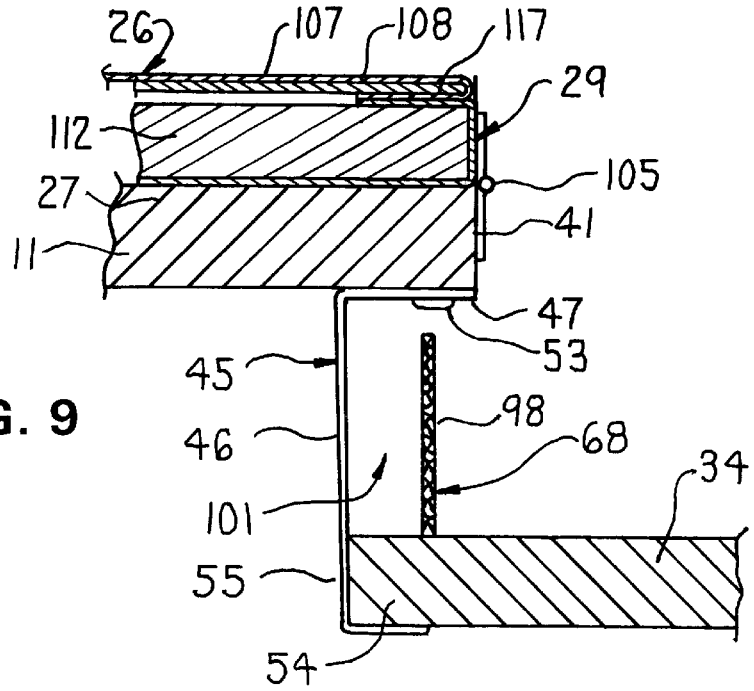
FIG. 9 is an elevational view in cross-section of an edge area of the storage compartment as taken along the line 9—9 of FIG. 5.

As seen in FIG. 9, the top flange 47 extends horizontally and is secured to the bottom of the desktop 11 by fasteners 53 which extend vertically through fastener holes 53*a*. The housing sides 45 thereby are suspended from the bottom of the desktop 11 and serve to secure the entire housing assembly to the desktop 11.

The bottom flange 48 extends generally horizontally and parallel with the top flange 47 and is adapted to support opposite side edges 54 of the bottom wall 34 thereon. The bottom wall 34 and housing sides 45 are joined together by fasteners 55 which are threaded horizontally therein through fastener holes 55*a*. The bottom wall 34 is suspended by the housing sides 45 which are disposed on the opposite sides thereof.

To enclose the rear side of the storage compartment 14, the rear flanges 50 extend inwardly in generally parallel relation with the front edge 19 of the desktop 11. The rear flanges 50, however, are laterally spaced apart to define a receptacle-receiving opening 56 therebetween.

The rear flanges 50 also extend rearwardly and then outwardly so as to be generally J-shaped when viewed from above. These rear flanges 50 define additional connector flanges 58 which will be discussed in greater detail with respect to FIG. 8. Fastener holes 59 also are provided to permit the flanges 50 to be fastened to the rear edge 60 of the bottom wall 34.

Figure 5:
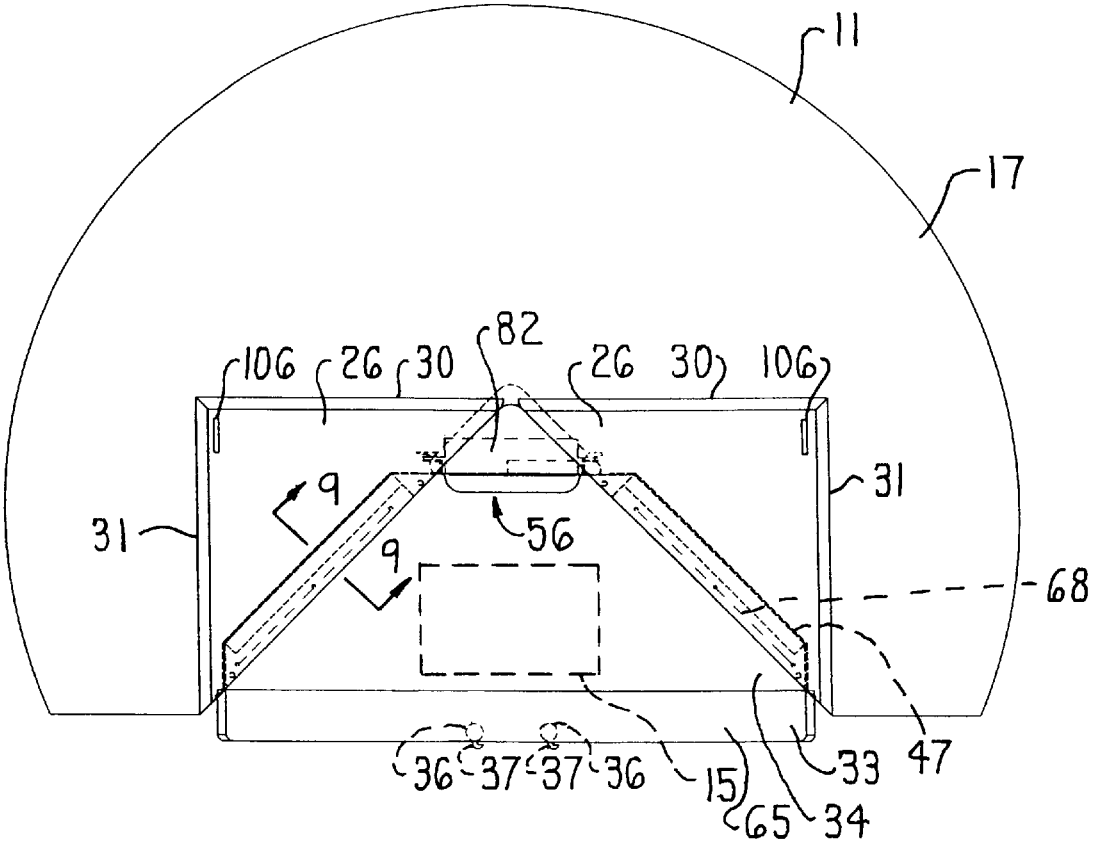
FIG. 5 is a plan view of the open computer desk.
Figure 6:
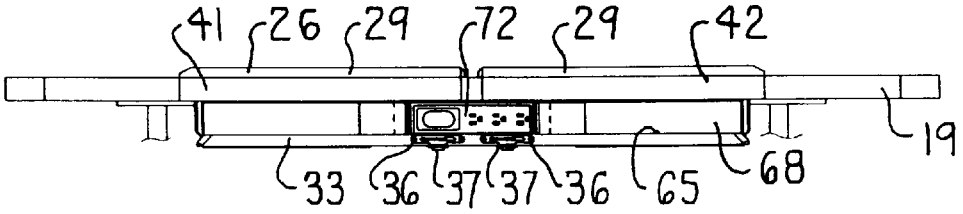
FIG. 6 is a front elevational view of the open is computer desk.

To enclose the front of the storage compartment 14, the front door 33 is hingedly connected to a front edge 61 of the bottom wall 34 whereby the vertical face of the front edge 61 contacts the front door 33 and prevents further downward movement of the door 33 once the front door 33 is disposed in the horizontal position illustrated in FIGS. 4–6.

The front wall also is formed with pockets 63 (FIG. 7) which each receive one of the lock assemblies 36 therein. When the lock assembly 36 is mounted to the front wall 34, hook-like latches 37 project outwardly therefrom and are adapted to engage the top doors 26 as will be discussed herein. Preferably, the front door 34 also has beveled edges to fit closely against the adjacent angled surfaces at the outermost ends of the front flanges 49 on the housing sides 45 when the door 34 is in the closed position.

The top surface of the front door 33 includes a wrist pad 65 for supporting the wrist of the user. In particular, the front door 34 when opened is supported by the bottom wall 34 in the horizontal position illustrated in FIG. 4 so that the front door 34 serves the additional function of acting as a wrist rest.

Further with respect to the upper surface of the bottom wall 34, additional pin holes 67 are provided near the front and rear edges 61 and 60 respectively to support a divider wall 68 as will be described herein. Also, the rear edge 60 of the bottom wall 34 includes a recess or notch which opens rearwardly and downwardly which thereby defines an access port 69 that opens vertically into the storage compartment 14 to permit cabling to pass therethrough.

Figure 7:
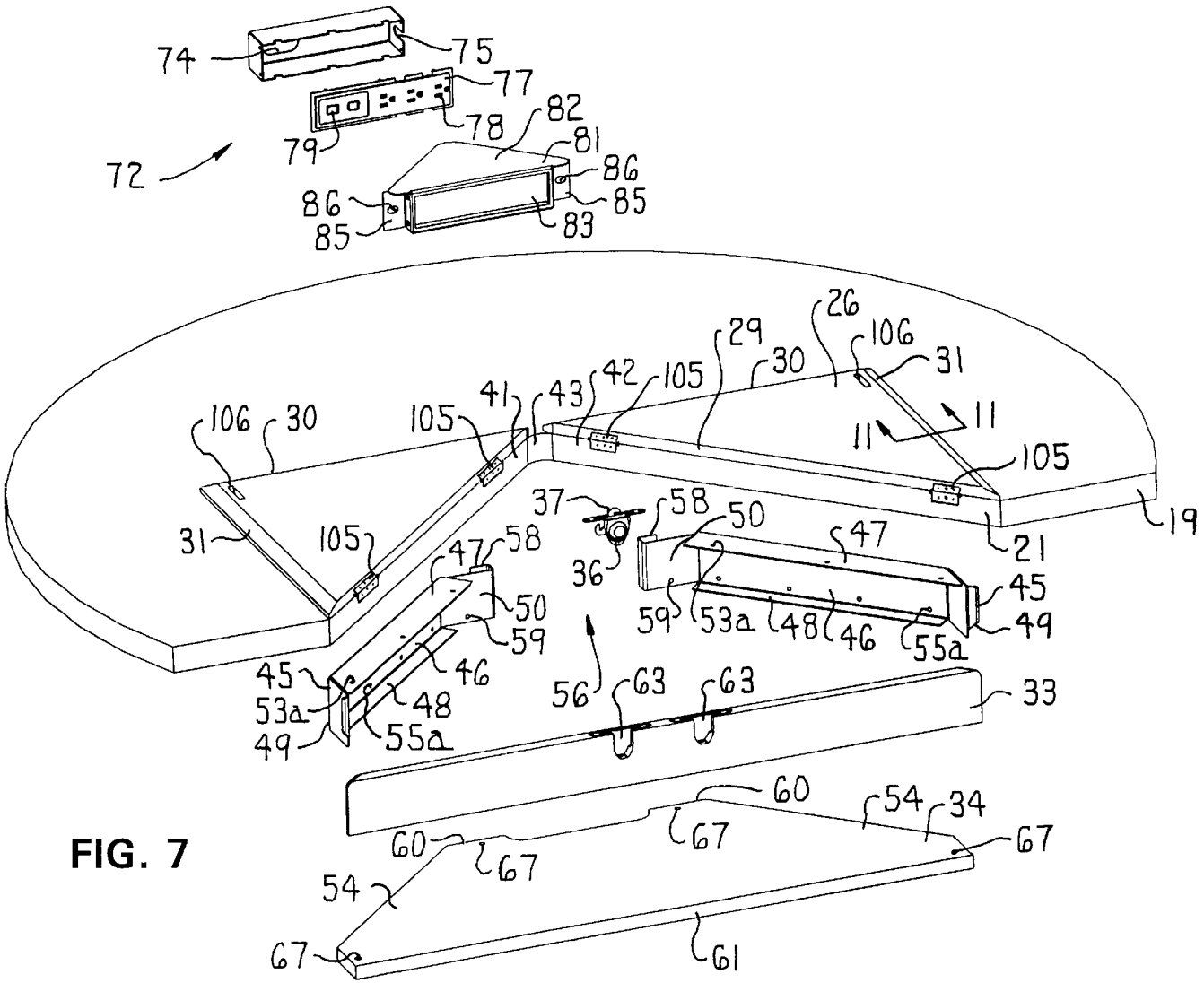
FIG. 7 is a an exploded view of the component parts of the laptop computer desk.
Figure 8:
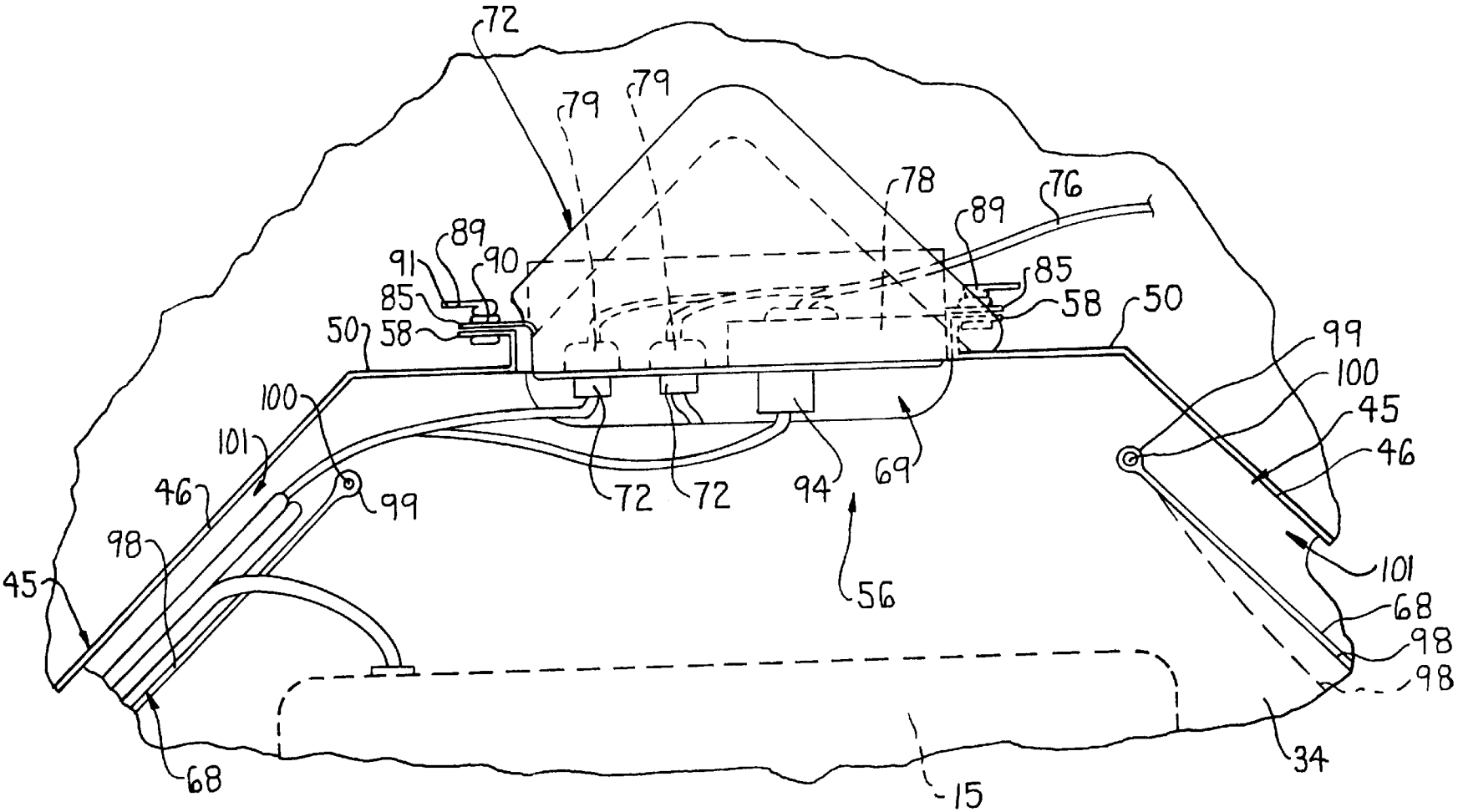
FIG. 8 is an enlarged partial plan view of a receptacle area thereof.

More particularly with respect to FIGS. 7 and 8, the storage compartment housing 12 also includes a receptacle unit 72 which fits into the receptacle-receiving opening 56 that is defined between the flanges 50. The receptacle unit 72 comprises a box-like rear housing 73 which includes first and second cable openings 74 and 75 that receive communication and power cabling 76 respectively therethrough.

The rear housing 73 is adapted to receive a receptacle 77 therein which is adapted to provide power outlets 78 such as conventional three prong outlets, and communication outlets 79. The receptacle unit 72 further includes a front housing 81 which joins to the rear housing 73 and secures the receptacle 77 therebetween.

The front housing 81 includes a triangular top cover plate 82 which encloses the opening 21 in the desktop 11 proximate to the apex 43 thereof. Also, a receptacle opening 83 is provided in the front face thereof to permit the power outlets 78 and communication outlets 79 to be accessible therethrough. When assembled together, the receptacle unit 72 is removal as a single unit.

To secure the receptacle unit 72 to the connector flanges 58, additional connector flanges 85 are provided on the front housing 81 so as to be disposed in adjacent facing relation with the opposing connector flanges 58 as seen in FIG. 8. The receptacle connector flanges 85 each include a hole 86 to permit a suitable fastener to be inserted therethrough into engagement with the corresponding apertures in the connector flange 58. As seen in FIG. 8, a preferred connector is a known cam lock 89. The cam lock 89 includes an elastomeric insert 90 which is inserted through the aligned openings of the connector flanges 58 and 85. The elastomeric insert 90 expands similar to a rivet when the cam lock handle 91 is pivoted to a locked position.

If necessary, the receptacle unit 72 can be removed by releasing the cam locks 89 and removing the receptacle unit 72 therefrom. This permits ready replacement of the receptacle unit 72 if different receptacle types are required.

When the receptacle unit 72 is installed, the laptop computer 15 has its own internal power and or communication supply point which is entirely enclosed within the storage compartment 14. Suitable electrical cords 94 or communication cords 95 can be connected to the receptacle unit 72 and connected to the computer 15. Additionally, other cabling such as printer cables and modem lines may be routed out of the interior storage compartment 14 through the access opening 69 formed through the bottom wall 34.

Since excess cabling may be located within the storage compartment 14, a divider wall 68 preferably is provided to the left and right of the computer 15. More particularly, each divider wall is defined by an elastomeric fabric screen 98 which includes sleeves 99 on the opposite ends thereof. The sleeves 99 are adapted to receive vertical pins 100 therethrough. The vertical pins 100 are inserted into the corresponding pin holes 67 in the bottom wall 34 such that horizontally elongate divider walls 68 are defined therebetween. Since the fabric screen 98 is flexible, a user can readily pull down an edge of the fabric screen 98 to access the cable compartment 101 which is defined behind each of the divider wall 68.

As result of this arrangement, the storage compartment 14 is provided with access locations for power and or communication connections and also is provided with interior storage compartments to facilitate cable management. Further, as can be seen in FIG. 5, additional space is provided to the left and right of the computer 15 such as for a mouse or the like.

Figure 10:
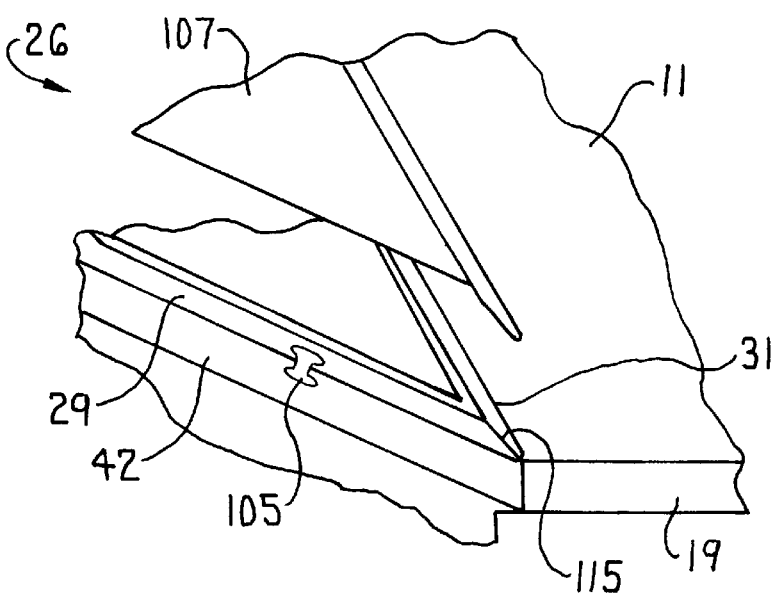
FIG. 10 is an exploded perspective view of a corner area of a door overlying the storage compartment.

With respect to the top doors 26, the hinged edges 29 are hingedly connected to the corresponding edge of the triangular opening 21 by hinges 105 (FIG. 7,9 and 10). The hinges 105 define horizontal pivot axes whereby the first surface 27 of each top door 26 is disposed coplanar with the worksurface 17 when the top door 26 is closed, and lies against the work surface 17 when the top door 26 is opened. When the top door 26 is opened, an opposite second surface 107 thereby faces upwardly and is exposed for use.

To lock the top doors 26 in the closed position, the second surface 107 is formed with a lock opening 106 in which is disposed a catch that is engaged with the latch 37 of the lock 36. As a result, each lock 36 is actuatable to secure a respective one of the doors 26 in the closed position. The locks 36 may be actuated independently of each other to permit one door 26 or the other to be opened independently of the other door.

Preferably, the second surface 107 is defined by a leather covering 108 or other suitable covering. This cover 108 is not only aesthetic but also functional as a writing surface. Since the top doors 26 have a triangular shape, the doors extend sidewardly away from the opening 21 when the open position. This thereby positions the covering 108 to the left and right sides of the storage compartment 14 which facilitates access and used by an occupant. Further, as result of these triangular components, the top doors 26 when in the open position do not extend sidewardly beyond the greatest sideward dimension of the front door 33, and do not extend rearwardly farther than the greatest front to rear dimension of the bottom wall 34. This triangular shape thereby minimizes the surface area of the worksurface 17 which is affected by the storage compartment 14 and the operation of the doors 26.

More particularly as to the shape of the doors 26, the doors 26 have the shape of a right triangle wherein the inner edge 30 and the front edge 31 are oriented at right angles to each other. Further, the angle between the hinged edge 29 and the edges 30 and 31 at each corner 115 is a 45 degree angle so that the doors 26 extend sidewardly away from the opening 21.

Further with respect to the doors 26, the inner and front edges 30 and 31 also are beveled to eliminate sharp right angle surfaces when the top doors 26 are opened. However, since it is desirable that the covering 108 be a leather or other similar material, the top doors 26 also have an improved construction for wrapping the door surfaces with the covering material.

Figure 11:
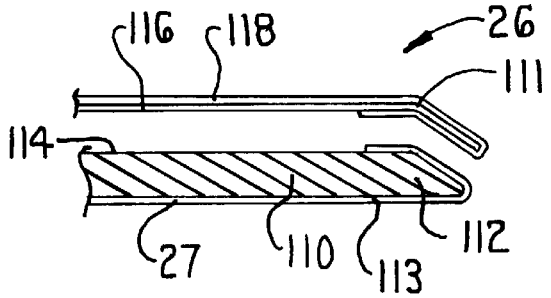
FIG. 11 is an exploded elevational view of a door edge as taken along line 11—11 of FIG. 7.

Referring to FIGS. 9–11, each door 26 is formed in two parts. In particular, each door 26 is formed from a base panel 110 and a cover panel 111 which ultimately are assembled together in facing relation to each other. More particularly, the base panel 110 has a rigid core 112, for example, formed from a medium density fiberboard or other rigid material. The core 112 includes a covering 113 which is formed of a matching covering material such as leather. The covering 113 covers one face of the core 112 to define the first surface 27, and also covers the three side edges 29, 30 and 31 and a small portion of the interior core surface 114. This minimizes bunching of covering material at the corners 115.

As for the cover panel 111, the cover panel 111 includes a thin rigid cover sheet 117 such as sheet metal or other rigid material which is bent along its edges to define beveled regions so as to match the shape of the base panel 110. The cover sheet 117 is itself covered with the covering 108 which thereby defines the second surface 107 of the top doors 26. The covering 108 overlies the outer surface 118 of the cover sheet 117 as well as a small edge portion of an interior surface 119 as generally illustrated in FIGS. 9 and 11. Here again, a minimum amount of material is provided at the corners 115.

The cover panel 111 is then secured to the base panel such as by an adhesive whereby the covering 113 on the base panel defines the exposed surface 27 while the covering 108 on the cover panel 111 defines the second surface 107 of the top door 26. This two-part construction provides an improved arrangement for covering a door with a material.

With the above-described arrangement of the laptop computer desk 10, a storage compartment 14 is provided which readily accommodates the computer 15 therein by providing sufficient space and a number of cabling connections to satisfy the requirements of the computer 15. In use, the computer 15 is placed into the storage compartment 14, and the individual cables of the computer 15 are then plugged into the receptacle unit 72. If there is excess cabling which typically will occur, this excess cabling can be stored in the cable compartment 101 as illustrated in FIG. 8.

If additional cables such as for printers or the like are present, which said cabling must extend out of the storage compartment 14 to a computer peripheral such as a printer, this additional cabling can be passed through the access opening 69 defined vertically through the bottom wall 34. Once the computer is set up, the cover of the computer 15 can be opened such that the cover extends vertically out of the storage compartment 15 during use, the front door 33 is maintained in a horizontal upward facing position as seen in FIG. 4 such that the front door 33 defines a wrist rest for the user.

Since the storage compartment 14 is triangular, additional storage areas 122 are defined to the left and right of the computer 15 which storage areas 122 may be used for storage or as support surfaces for writing instruments, a computer mouse, microphone or the like. When work is completed, the top doors 26 are folded over to the horizontal closed position while the front door 33 is pivoted upwardly to the vertical position to fully enclose the storage compartment 14. The locks 36 are then actuated such that their respective latches engage a respective one of the top doors 26 to securely store the laptop 15 therein.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A computer desk comprising:

a horizontally enlarged worksurface which includes a base structure supported on a floor, said worksurface having a generally triangular opening which is disposed proximate a front worksurface edge thereof and opens upwardly, said front worksurface edge extending laterally; and a computer compartment housing which is disposed below said worksurface adjacent to said triangular opening, said compartment housing including vertical side walls which extend downwardly from said worksurface, a horizontal bottom wall extending laterally between said side walls, and a front wall which extends laterally between said side walls proximate said front worksurface edge to define a hollow storage compartment, said compartment housing being enclosed by a pair of triangular doors which are adapted to overlie left and right sections of said triangular opening of said worksurface, each of said doors including a hinged edge which is hingedly connected to said worksurface, a front edge and an inner edge, said front edge extending laterally and being disposed proximate said front worksurface edge when said door is in a closed position overlying said storage compartment, said hinged edge extending rearwardly from said front edge along a corresponding edge of said triangular opening and defining a horizontal pivot axis about which said door pivots between said closed position and an open position overlying said worksurface, said inner edges of said doors being disposed proximate each other over a central area of said triangular opening when in said closed position, and said doors when in said open position extending leftwardly and rightwardly away from said triangular opening.

2. A computer desk according to claim 1, wherein said front wall is hinged to said bottom wall so as to pivot vertically between a vertical closed position and a horizontal open position, an interior surface of said front wall facing upwardly when in said open position to define a wrist rest for an occupant.

3. A computer desk according to claim 2, wherein said front wall includes lock means for engaging said doors to lock said doors and said front wall together in said respective closed positions.

4. A computer desk according to claim 3, wherein each of said doors generally defines a right triangle wherein said inner edge and said front edge are substantially perpendicular to each other.

5. A computer desk according to claim 1, wherein said doors when in said closed position are substantially coplanar with said worksurface.

6. A computer desk according to claim 1, wherein said compartment housing includes a receptacle unit fixedly secured therein which defines power and/or communication receptacles which are accessible within the hollow compartment.

7. A computer desk according to claim 6, wherein said receptacle unit is secured to said compartment housing by removable fasteners such that said receptacle unit is removable, said side walls of said housing compartment defining an opening therethrough in which said receptacle unit is received.

8. A computer desk according to claim 7, wherein said storage compartment includes at least one divider wall therein which defines a cable compartment within said storage compartment.

9. A computer desk according to claim 8, wherein said compartment housing includes at least one access opening extending therethrough in communication with said storage compartment and an exterior of said computer therethrough for the passage of cabling.

10. A computer desk according to claim 1, wherein each of said doors is defined by a base panel and a cover panel which are joined together in facing relation, said base panel comprising a rigid triangular core and a first facing material which overlies an outer side of said core and wraps about peripheral edges of said core and partially onto an inner side of said core which is disposed opposite said outer side thereof, said core having beveled edges along at least two sides thereof, said cover panel comprising a sheet-like plate which is beveled along at least two edges thereof so as to correspond to the shape of said core, said cover panel including a second facing material which overlies an outer side of said plate and wraps about peripheral edges of said plate and partially onto an inner side of said plate which is disposed opposite said outer side thereof, said base panel and said cover panel being joined together such that said first facing material defines one exposed face of said door and said second facing material defines an opposite exposed face of said door.

11. A computer desk comprising:

a horizontally enlarged worksurface which includes a base structure supported on a floor, said worksurface having an opening which is disposed proximate a front worksurface edge thereof and opens upwardly, said front worksurface edge extending laterally; and a computer compartment housing which is disposed below said worksurface adjacent to said opening, said compartment housing including vertical side walls which extend downwardly from said worksurface, a horizontal bottom wall extending laterally between said side walls, and a front wall which extends laterally between said side walls proximate said front edge of said worksurface to define a hollow storage compartment below said worksurface, said side walls defining a receptacle opening in a rear region of said storage compartment and said storage compartment including a receptacle unit which is removably received in said receptacle opening, said receptacle unit including outlets which are accessible from said storage compartment and power and/or communication cabling which extends to an exterior thereof, said front wall being hingedly connected to said bottom wall so as to be movable between an open position and a closed position wherein said front wall encloses said storage compartment when in said closed position and extends horizontally outwardly from a front edge of said bottom wall when in said open position, said front wall including a support pad on an inner face thereof which faces upwardly when in said open position to define a wrist rest for a user, said compartment housing further including doors which are hingedly connected to said worksurface so as to be movable between a closed position overlying said storage compartment and an open position extending outwardly away from said opening in said worksurface.

12. A computer desk according to claim 11, which includes at least one divider wall within said storage compartment proximate said side walls which defines a cable compartment for storage of excess cabling therein.

13. A computer desk according to claim 12, wherein said divider wall comprises upstanding support members which project upwardly from said bottom wall and a flexible fabric divider screen which extends horizontally between said support members, said divider screen being generally parallel to said side wall to define said cable compartment therebetween.

14. A computer desk according to claim 12, wherein said bottom wall includes an access opening which opens into said storage compartment to permit cabling to be inserted into said storage compartment when said doors and said front door are in said closed positions.

15. A computer desk according to claim 14, wherein said receptacle unit includes connectors for removably connecting said receptacle unit to said compartment housing wherein said receptacle unit is accessible from said storage compartment through said receptacle opening.

16. A computer desk according to claim 11, wherein said storage compartment is triangular when viewed from above and said doors have a triangular shape so as to overlie left and right sections of said opening of said worksurface.

17. A computer desk according to claim 11, wherein said front wall includes lock means for engaging said doors to lock said doors and said front wall together in said respective closed positions.

18. A computer desk according to claim 17, wherein said lock means comprise first and second lock mechanisms which each engage a respective one of said doors, said first and second lock mechanisms being separately actuatable to permit said doors to be unlocked and opened independently of the other.

* * * * *